US008550940B2

(12) United States Patent
Fitchett

(10) Patent No.: US 8,550,940 B2
(45) Date of Patent: Oct. 8, 2013

(54) SYSTEMS AND METHODS FOR EVALUATING A GOLF BALL DESIGN

(75) Inventor: Derek A. Fitchett, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 335 days.

(21) Appl. No.: 12/958,843

(22) Filed: Dec. 2, 2010

(65) Prior Publication Data

US 2012/0137769 A1 Jun. 7, 2012

(51) Int. Cl.
*A63B 57/00* (2006.01)
*G01N 19/00* (2006.01)

(52) U.S. Cl.
USPC ..... 473/409; 73/865.9

(58) Field of Classification Search
USPC ..... 73/865.9; 473/409
See application file for complete search history.

(56) References Cited

U.S. PATENT DOCUMENTS

| | | | |
|---|---|---|---|
| 3,772,750 | A | 11/1973 | Hauser |
| 5,064,199 | A | 11/1991 | Morell |
| 5,225,133 | A | 7/1993 | Ihara et al. |
| 5,437,578 | A | 8/1995 | Wasserberger et al. |
| 5,585,440 | A | 12/1996 | Yamada et al. |
| 6,149,128 | A | 11/2000 | Gallant et al. |
| 6,171,091 | B1 | 1/2001 | Bettencourt |
| 6,319,446 | B1 | 11/2001 | Bettencourt |
| 6,676,543 | B2 | 1/2004 | Endo |
| 6,945,880 | B2 | 9/2005 | Aoyama et al. |
| 7,004,855 | B2 | 2/2006 | Jordan |
| 7,033,287 | B2 | 4/2006 | Aoyama et al. |
| 7,226,369 | B2 | 6/2007 | Aoyama et al. |
| 7,306,528 | B2 | 12/2007 | Jordan |
| 7,431,670 | B2 | 10/2008 | Nardacci et al. |
| 7,473,195 | B2 | 1/2009 | Aoyama et al. |
| 2003/0109330 | A1 | 6/2003 | Nesbitt et al. |
| 2004/0213984 | A1 | 10/2004 | Avis |
| 2005/0215653 | A1 | 9/2005 | Avis |
| 2006/0068931 | A1 | 3/2006 | Aoyama et al. |
| 2008/0064528 | A1 | 3/2008 | Jordan |
| 2008/0064531 | A1 | 3/2008 | Nardacci et al. |
| 2008/0317892 | A1 | 12/2008 | Aoyama et al. |
| 2009/0088273 | A1 | 4/2009 | Nardacci et al. |
| 2009/0186720 | A1 | 7/2009 | Aoyama et al. |

FOREIGN PATENT DOCUMENTS

| | | |
|---|---|---|
| CN | 201120498841.1 | 1/2013 |

OTHER PUBLICATIONS

Partial European Search Report in European Patent Application No. EP 11191639.1, mailed on Mar. 1, 2012.
Partial European Search Report in European Patent Application No. EP 11191640.9, mailed on Mar. 20, 2012.
Extended European Search Report and Written Opinion in European Patent Application No. 11191640.9, mailed on Jul. 5, 2012.

(Continued)

*Primary Examiner* — Hezron E Williams
*Assistant Examiner* — David Z Huang
(74) *Attorney, Agent, or Firm* — Plumsea Law Group, LLC

(57) ABSTRACT

Systems and methods for evaluating a golf ball design are disclosed. In one implementation, a method for evaluating a golf ball design may comprise designing a proposed golf ball having a size and dimple design; determining a specific gravity of the proposed golf ball; selecting a material for a test golf ball that will mimic the specific gravity of the proposed golf ball when the material is formed into a test golf ball having substantially the same size, shape, and dimple pattern as the proposed golf ball, but having a predetermined construction differing from the proposed golf ball; forming the selected material into the size and dimple design of the proposed golf ball to form the test golf ball; and testing the test golf ball to evaluate the golf ball design.

17 Claims, 11 Drawing Sheets

(56) References Cited

OTHER PUBLICATIONS

Extended European Search Report for European Patent Application No. EP11191639.1, mailed Jun. 25, 2012.

United States Golf Association and R&A Rules Limited, Actual Launch Conditions Overall Distance and Symmetry Test Procedure (Phase II), Revision 1, Jun. 1, 2004.

Notification of Grant of Patent Right for Utility Model for Chinese Utility Model Patent Application No. 201120498589.4 issued on Feb. 26, 2013.

Communication pursuant to Rule 70(2) & 70a(2) EPC and reference to Rule 39(1) EPC mailed Jul. 30, 2012 for European Patent Application No. 11191639.1.

Response to communication pursuant to Rule 70(2) & 70a(2) EPC and reference to Rule 39(1) EPC filed on Dec. 18, 2012 for European Patent Application No. 11191639.1.

Notification of Grant of Patent Right for Utility Model for Chinese Utility Model Patent Application No. 201120498841.1 issued on Sep. 25, 2012.

Communication pursuant to Rule 70(2) & 70a(2) EPC and reference to Rule 39(1) EPC mailed Aug. 13, 2012 for European Patent Application No. 11191640.9.

Response to communication pursuant to Rule 70(2) & 70a(2) EPC and reference to Rule 39(1) EPC filed on Dec. 18, 2012 for European Patent Application No. 11191640.9.

Office Action mailed Mar. 11, 2013 in U.S. Appl. No. 12/958,863.

SYSTEMS AND METHODS FOR EVALUATING A GOLF BALL DESIGN

BACKGROUND

The present invention relates to systems and methods for evaluating a golf ball design, and more particularly, to systems and methods for rapidly manufacturing and evaluating a test golf ball that mimics the performance of a final desired golf ball using a substitute material in a one-piece or multi-piece golf ball having substantially the same dimple design and specific gravity of the desired final golf ball design.

Golf ball manufacturers continually strive to improve the performance of golf balls, for example, in terms of travel distance and control. While a golf ball may appear simple in shape, the many possible variations in surface features greatly affect a golf ball's performance. Slight adjustments in dimple patterns, shapes, and sizes may yield widely varying performance characteristics. Thus, traditionally, the golf ball design process has largely involved a trial and error approach, in which prototypes of proposed golf ball designs are first made as nonfunctional prototypes, which are evaluated for their visual appearance and are not suitable for testing, such as aerodynamic testing. After the visual evaluation, actual functional golf ball prototypes are manufactured in small batches using the same complicated manufacturing processes used to produce commercially-sold golf balls. The small batch of functional golf ball prototypes is then performance-tested. The traditional prototyping processes, from conception to prototype, therefore typically require extensive resources to manufacture molds and to injection mold multiple layers of the golf balls, which often have two- or three-piece constructions. Moreover, the first prototypes rarely provide the desired results, necessitating changes in the design and further prototyping and testing.

Consequently, the traditional prototyping approaches typically require a substantial commitment of money and time, and may undesirably delay a product's introduction to the market. During the research and development phase, when a manufacturer is considering many different golf ball designs and the designs are rapidly changing, the conventional prototyping techniques may significantly hinder a manufacturer from swiftly bringing new designs to the market. Manufacturers therefore desire the ability to quickly and conveniently test and evaluate proposed golf ball designs, to efficiently identify golf ball surface designs that optimize performance.

SUMMARY

Embodiments provide systems and methods for evaluating a golf ball design, which form a test golf ball using a substitute material in a one-piece or multi-piece golf ball having the same dimple design and specific gravity of a desired final golf ball design. The systems and methods may provide a limited-use golf ball that mimics the dimple design and specific gravity of a desired final golf ball design while being able to withstand several impacts as necessary for testing. The systems and methods may involve determining the overall specific gravity of the desired final golf ball design and formulating a material that mimics the overall specific gravity in a one-piece or multi-piece construction and that is suitable for testing.

One aspect provides a method for evaluating a golf ball design. The method may include designing a proposed golf ball having a size, a dimple design, and a multi-layered construction, the proposed golf ball comprising the golf ball design. A specific gravity of the proposed golf ball may be determined. A material for a test golf ball may be selected. The material may provide the test golf ball with a specific gravity substantially equal to the specific gravity of the proposed golf ball, when the material is formed into a monolithic test golf ball having substantially the same size and dimple pattern as the proposed golf ball. The selected material may be formed into the monolithic test golf ball. The monolithic test golf ball may then be tested to evaluate the golf ball design.

In another aspect, the proposed golf ball may have a two-piece construction or a three-piece construction.

In another aspect, selecting the material may comprise selecting a base material having a base material specific gravity, and doping the base material to change the base material specific gravity to substantially equal the specific gravity of the proposed golf ball.

In another aspect, the base material may comprise one of acrylonitrile-butadiene-styrene plastic and polyoxymethylene plastic.

In another aspect, forming the selected material into the monolithic test golf ball may comprise forming the selected material into a block; machining the block into a golf ball blank substantially equal in size to the size of the proposed golf ball; and machining the dimple design of the proposed golf ball into the golf ball blank.

In another aspect, machining the block into the golf ball blank may comprise forming index tabs on the golf ball blank, machining the dimple design into the golf ball blank may comprise aligning the dimple design using the index tabs, and the method may further comprise removing the index tabs after machining the dimple design into the golf ball blank.

In another aspect, forming the selected material into the monolithic test golf ball may comprise forming a mold corresponding to the size and dimple design of the proposed golf ball; injecting the selected material in liquid form into the mold; cooling the material to solidify the material into the size and dimple design of the proposed golf ball to form the monolithic test golf ball; and removing the monolithic test golf ball from the mold.

In another aspect, testing the monolithic test golf ball may comprise determining aerodynamic properties of the test golf ball.

In another aspect, the aerodynamic properties may include a coefficient of lift and a coefficient of drag.

In another aspect, testing the monolithic test golf ball may comprise subjecting the monolithic test golf ball to at least fifteen impacts, and selecting the material may comprise selecting a material that withstands the at least fifteen impacts when formed into the monolithic test golf ball.

In another aspect, selecting the material may comprise selecting a material that, when formed in the size and dimple design of the proposed golf ball, provides a monolithic test golf ball having a mass substantially equal to a computed mass of the proposed golf ball.

Another aspect provides another method for evaluating golf ball designs. A proposed golf ball having an outer spherical shape and a multi-layered construction may be designed. A specific gravity of the proposed golf ball may be determined. A test golf ball having the outer spherical shape and a one-piece construction may be designed. A material that provides the test golf ball with a specific gravity substantially equal to the specific gravity of the proposed golf ball may be selected. A plurality of monolithic golf ball blanks may be formed from the selected material to provide an inventory of monolithic golf ball blanks, each of the monolithic golf ball blanks having an outer spherical shape substantially equal to the outer spherical shape of the proposed golf ball. A first dimple design for the proposed golf ball may be designed. The first dimple design may be formed into a first monolithic golf ball blank of the plurality of monolithic golf ball blanks to form a first test golf ball. The first test golf ball may then be tested to evaluate the first dimple design. A second dimple design for the proposed golf ball may be designed based on test results of the first test golf ball. The second dimple design may be formed into a second monolithic golf ball blank of the plurality of monolithic golf ball blanks to form a second test golf ball. The second test golf ball may then be tested to evaluate the second dimple design.

In another aspect, the proposed golf ball may comprise a first proposed golf ball and the plurality of monolithic golf ball blanks may comprise a plurality of first monolithic golf ball blanks, and the method may further comprise designing a second proposed golf ball having a second outer spherical shape and a multi-layered construction different from the multi-layered construction of the first proposed golf ball; determining a second specific gravity of the second proposed golf ball; designing a second test golf ball having the second outer spherical shape and a one-piece construction; selecting a second material that provides the second test golf ball with a specific gravity substantially equal to the specific gravity of the second proposed golf ball; forming a plurality of second monolithic golf ball blanks from the selected second material to provide an inventory of second monolithic golf ball blanks, each of the second monolithic golf ball blanks having an outer spherical shape substantially equal to the second outer spherical shape of the second proposed golf ball; designing a third dimple design; selecting to which of the first proposed golf ball and the second proposed golf ball to apply the third dimple design; selecting, from the inventories of first and second monolithic golf ball blanks, a first monolithic golf ball blank if the first proposed golf ball is selected and selecting from the inventory a second monolithic golf ball blank if the second proposed golf ball is selected; forming the third dimple design into the selected monolithic golf ball blank to form a third test golf ball; and testing the third test golf ball.

Another aspect provides another method for evaluating golf ball designs. A plurality of proposed golf balls may be designed, each proposed golf ball having a multi-layered construction, an outer spherical shape, and an outer spherical surface. For each proposed golf ball, a proposed design mass of the proposed golf ball may be determined, assuming the outer spherical surface to be smooth. For each proposed golf ball, an average total dimple volume may be designated. For each proposed golf ball, a material may be selected that, when formed into a monolithic test golf ball having the outer spherical shape of the proposed golf ball with a smooth outer spherical surface, weighs the sum of the proposed design mass and the mass of a volume of the material equal to the average total dimple volume. For each proposed golf ball, a plurality of monolithic golf ball blanks may be formed from the selected material, to provide an inventory of monolithic golf ball blanks for each proposed golf ball. A dimple design may be designed. A proposed golf ball to which the dimple design is to be applied may be selected. A monolithic golf ball blank that corresponds to the selected proposed golf ball may be retrieved from the inventory. The dimple design may be formed into the retrieved blank to form a monolithic test golf ball. The monolithic test golf ball may then be tested.

In another aspect, the plurality of proposed golf balls may comprise a first proposed golf ball having a two-piece inner construction and a second proposed golf ball having a three-piece inner construction.

In another aspect, a test golf ball fabrication apparatus may automatically execute, without human intervention, the retrieval from the inventory of the blank that corresponds to the selected proposed golf ball and the formation of the dimple design into the retrieved blank.

In another aspect, the average total dimple volume may comprise 0.75 to 1.3% of an entire volume of the each proposed golf ball without dimples.

In another aspect, the average total dimple volume may comprise a first average total dimple volume, the material may comprise a first material, the plurality of monolithic golf ball blanks may comprise a plurality of first monolithic golf ball blanks corresponding to the first average total dimple volume, the dimple design may comprise a first dimple design, and the method may further comprise designating, for each proposed golf ball, a second average total dimple volume; selecting, for each proposed golf ball, a second material that, when formed into a monolithic test golf ball having the outer spherical shape of the proposed golf ball with a smooth outer spherical surface, weighs the sum of the proposed design mass and the mass of a volume of the material equal to the second average total dimple volume; forming, for each proposed golf ball, a plurality of second monolithic golf ball blanks from the selected second material, to provide an inventory of second monolithic blanks for each proposed golf ball; designing a second dimple design having a total dimple volume; selecting a second proposed golf ball to which the second dimple design is to be applied; retrieving a first monolithic golf ball blank corresponding to the second proposed golf ball if the total dimple volume of the second dimple design is closer in value to the first average total dimple volume than the second average total dimple volume; retrieving a second monolithic golf ball blank corresponding to the second proposed golf ball if the total dimple volume of the second dimple design is closer in value to the second average total dimple volume than the first average total dimple volume; forming the second dimple design into the retrieved first or second monolithic golf ball blank to form a second monolithic test golf ball; and testing the second monolithic test golf ball.

Another aspect provides another method for evaluating golf ball designs. A plurality of proposed golf balls may be designed, each proposed golf ball having a multi-layered construction, an outer spherical shape, and an outer spherical surface. For each proposed golf ball, an undimpled mass of the proposed golf ball may be determined, assuming the outer spherical surface to be smooth. For each proposed golf ball, a material may be selected that, when formed into a monolithic test golf ball having the outer spherical shape of the proposed golf ball with a smooth outer spherical surface, weighs the undimpled mass. For each proposed golf ball, a plurality of monolithic golf ball blanks may be formed from the selected material, to provide an inventory of monolithic golf ball blanks for each proposed golf ball. A dimple design may be designed. A proposed golf ball to which the dimple design is to be applied may be selected. A monolithic golf ball blank that corresponds to the selected proposed golf ball may be retrieved from the inventory. The dimple design may be formed into the retrieved blank to form a monolithic test golf ball. The monolithic test golf ball may then be tested.

In another aspect, the plurality of proposed golf balls may comprise a first proposed golf ball having a two-piece inner construction and a second proposed golf ball having a three-piece inner construction.

Another aspect provides a system for evaluating a golf ball design, which may comprise a computer golf ball design apparatus, a test golf ball fabrication apparatus, and a testing apparatus. The computer golf ball design apparatus may be programmed to receive instructions designating a proposed golf ball having a size and dimple design and a multi-layered construction, the proposed golf ball comprising the golf ball design, determine a specific gravity of the proposed golf ball, and select a material for a monolithic test golf ball having substantially the same size and dimple pattern as the proposed golf ball, wherein the material provides the monolithic test golf ball with a specific gravity substantially equal to the specific gravity of the proposed golf ball. The test golf ball fabrication apparatus may be configured to form the selected material monolithically into the size and dimple design of the proposed golf ball to form the monolithic test golf ball. The testing apparatus may be configured to test the monolithic test golf ball to evaluate the golf ball design.

In another aspect, the test golf ball fabrication apparatus may comprise one of an injection molding machine and an injection press.

In another aspect, the test golf ball fabrication apparatus may comprise a milling machine that mills the monolithic test golf ball from a monolithic block of the selected material.

In another aspect, the testing apparatus may comprise an indoor testing range.

Other systems, methods, features and advantages of the invention will be, or will become, apparent to one of ordinary skill in the art upon examination of the following figures and detailed description. It is intended that all such additional systems, methods, features and advantages included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Embodiments provide systems and methods for quickly evaluating a golf ball design using rapid prototyping techniques. The prototyping techniques may involve forming a one-piece or multi-piece test golf ball having substantially the same dimple design and specific gravity as a proposed multi-layered golf ball. The prototype test golf ball may be performance-tested (e.g., aerodynamic testing) to evaluate the proposed multi-layered golf ball.

In embodiments, a fast prototyping technique may fabricate a test golf ball from a material (e.g., plastic) having a specific gravity matching that of the desired playing ball design. The test golf ball may be a one-piece or multi-piece sample, preferably durable enough to withstand fifteen impacts. The impacts may be impacts by a golf club swung by a person or machine, or may be simulated impacts of a golf club using a substitute object, such as a metal plate. Any type of material may be used to achieve an appropriate specific gravity. Preferable base materials include acrylonitrile-butadiene-styrene plastic (ABS) and polyoxymethylene plastic (e.g., the product DELRIN™, manufactured by E.I. du Pont de Nemours and Company of Wilmington, Del.) because they are relatively easy to machine. Base materials may be doped to provide a desired specific gravity.

Test golf balls that mimic the specific gravity of a final design enable early aerodynamic testing during the prototyping stage. By making the specific gravity the same or substantially the same as that of the desired final golf ball design, golf ball designers may quickly obtain estimates for the coefficient of lift ($C_L$ and the coefficient of drag ($C_D$), as well as other aspects of golf ball and dimple performance such as velocity, spin rate, carry distance, overall distance, and flight time.

In enabling early testing of new dimple patterns, the rapid prototyping techniques may avoid the costly delays involved in the traditional approaches to golf ball design evaluation, which typically require production of a mold and actual manufacturing of the proposed golf ball design.

Figure 1:
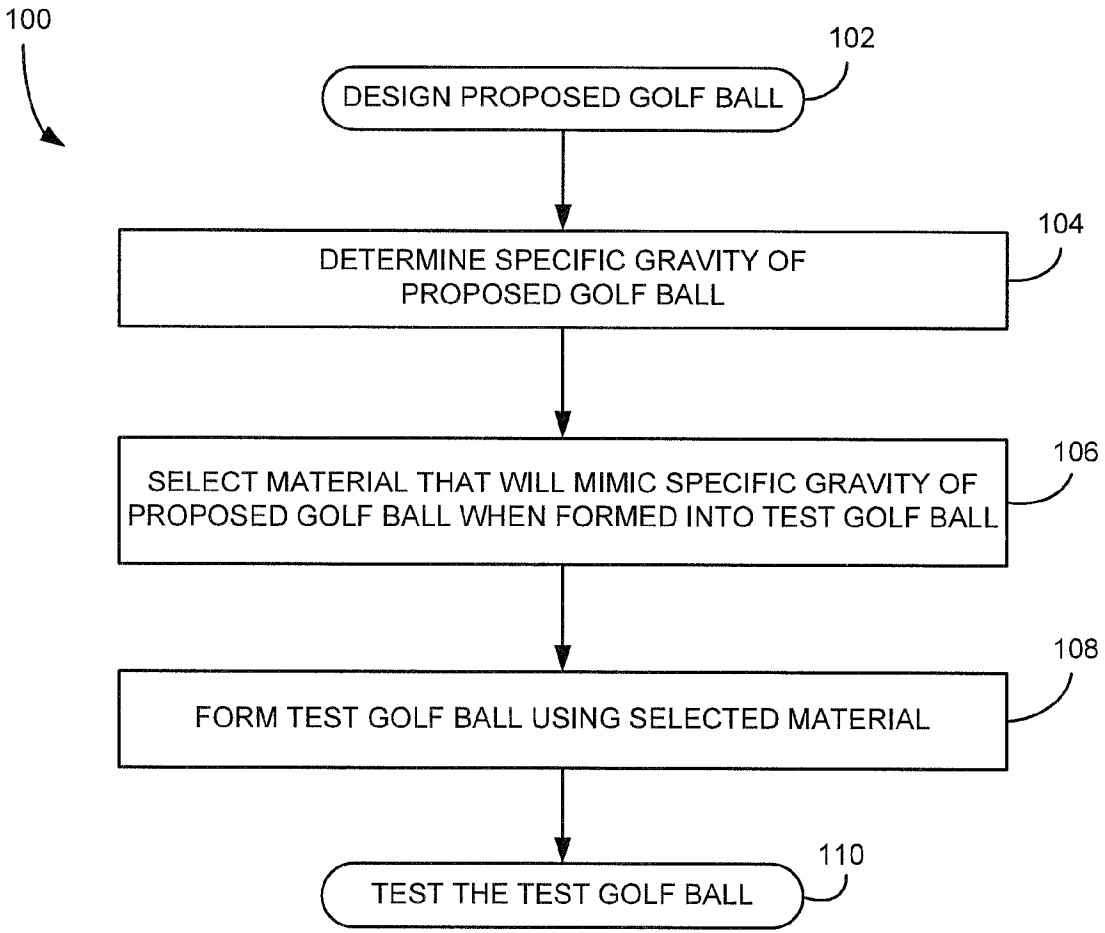
FIG. 1 is a flowchart that illustrates an embodiment of a method for evaluating a proposed golf ball design.
Figure 2:
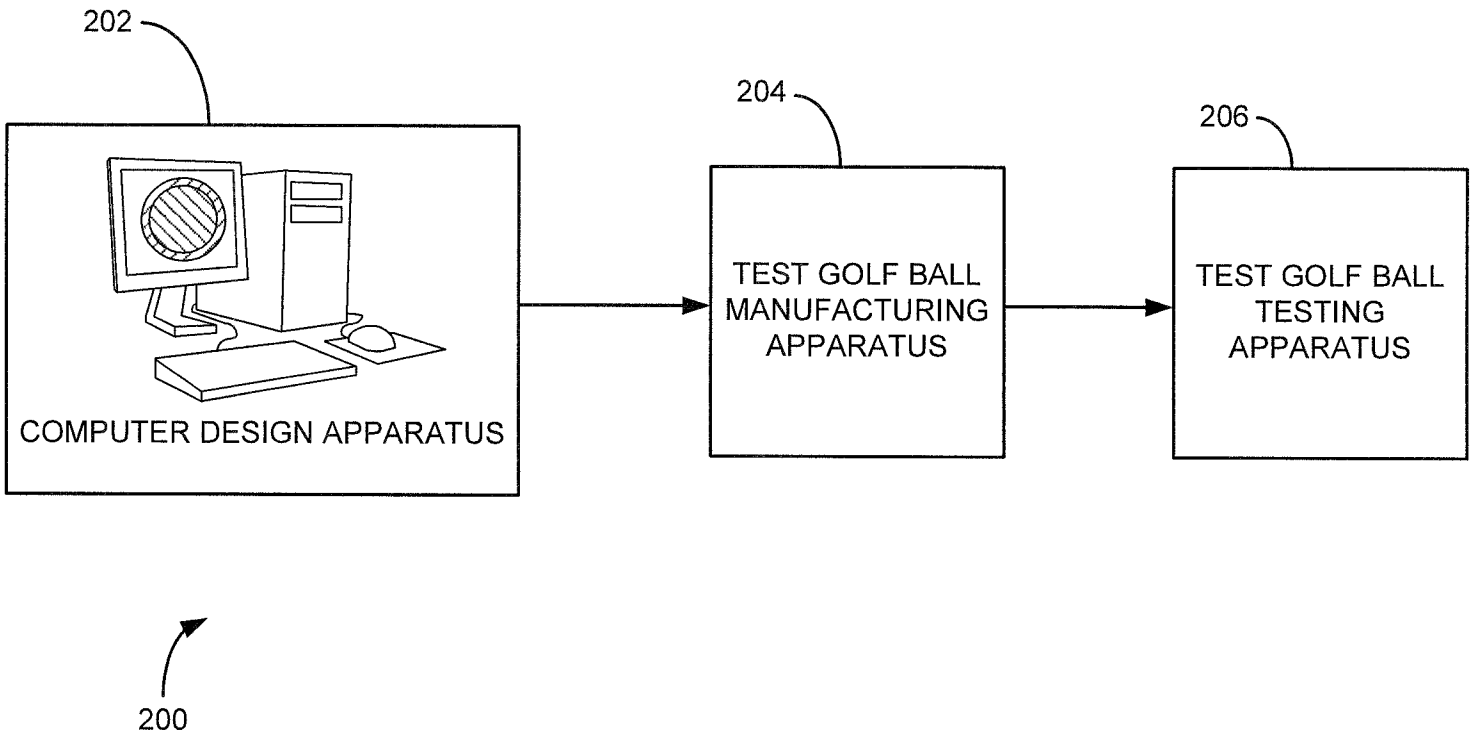
FIG. 2 is a schematic diagram illustrating an embodiment of system for evaluating a proposed golf ball design.

FIGS. 1 and 2 illustrate embodiments of a method 100 and system 200, respectively, for evaluating a proposed golf ball design. As shown in FIG. 1, method 100 begins in step 102 by designing the proposed golf ball. The proposed golf ball may have a certain size, construction, and dimple design. The size may correspond to widely accepted rules governing the game of golf, for example, specifying that the diameter of the ball be no less than 1.680 inches (42.67 mm). The construction may be a one-piece construction or a multi-layered construction, such as a two-piece or three-piece construction. Each component of the construction may be made of one or more materials. The dimple design may vary, for example, in terms of dimple shape, pattern, placement, and volume.

In designing the proposed golf ball, a designer may use a computer design apparatus, such as apparatus 202 shown in FIG. 2. Design apparatus 202 may include computer aided design (CAD) software that may enable the designer to create a proposed golf ball design. The CAD software and other software may also, to a certain extent, enable the designer to model the performance of a proposed golf ball design. However, observing on a computer the appearance and theoretical performance of the design may provide limited information, making it more desirable to observe an actual prototype of the golf ball design.

After designing the proposed golf ball, method 100 may continue in step 104 by determining the specific gravity of the proposed golf ball. The term "specific gravity" as used herein refers to the ratio of the density of a material to the density of water at a specified temperature and pressure, such as 3.98 degrees Celsius and 1 atmosphere. Density is mass divided by volume. The specific gravity may be found by considering all of the components of the proposed golf ball (e.g., the different layers), and the volume and material of each of the components. By considering all of the components, an overall specific gravity for the proposed golf ball may be determined. In embodiments, a designer may use a computer design apparatus, such as computer design apparatus 202 of FIG. 2, to determine the specific gravity. A computer design apparatus may provide computational tools of CAD software and other software, to determine the volume, mass, density, weight, and/or specific gravity of the proposed golf ball and/or individual components of the proposed golf ball.

Once the specific gravity of the proposed golf ball has been determined, method 100 may continue in step 106 by selecting a material for a test golf ball that will mimic the specific gravity of the proposed golf ball, when the material is formed into a test golf ball having substantially the same size and dimple pattern as the proposed golf ball, but having a predetermined inner construction differing from the inner construction of the proposed golf ball. In other words, step 106 may include selecting a material for a test golf ball that provides the test golf ball with a specific gravity substantially equal to the specific gravity of the proposed golf ball, when the material is formed into a test golf ball having substantially the same size and dimple pattern as the proposed golf ball, but having a predetermined inner construction differing from the inner construction of the proposed golf ball. In one embodiment, the selected material may provide a test golf ball having substantially the same mass as the mass of the proposed golf ball.

The predetermined inner construction of the test golf ball may facilitate rapid, inexpensive manufacturing of the test golf ball. Any suitable construction may be used, including solid, hollow, one-piece, multi-piece, single layer, and multiple layers. In one embodiment, the predetermined inner construction may be a solid one-piece, or monolithic, construction. The terms "monolithic" and "monolithically" as used herein refer to the concept of a one-piece structure formed from a single material (which may be a material mixture, as described below).

In another embodiment, the predetermined inner construction may be a two-piece construction in which two solid hemispherical portions are joined to form a substantially solid test golf ball. The solid hemispherical portions may be joined, for example, by an adhesive, by welding the portions together, by a mechanical connection, or by some combination thereof.

Figure 6A:
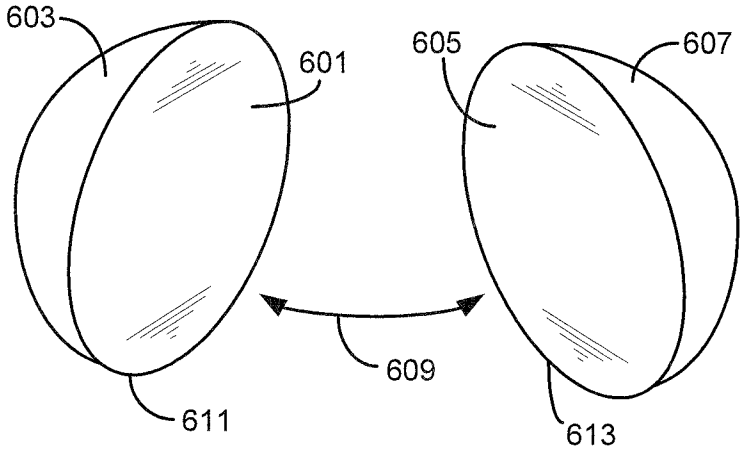
FIG. 6A is a schematic diagram of an exploded isometric view of an embodiment of a two-piece test golf ball formed from substantially solid hemispherical portions joined at their interior faces.

In one implementation, two solid hemispherical portions may be joined at their interior faces. FIG. 6A illustrates an embodiment of this type of two-piece construction, showing a first interior face 601 of a first hemispherical portion 603 joining the second interior face 605 of a second hemispherical portion 607, as represented by the arrow 609. Portions 603 and 607 may be joined, for example, by an adhesive applied to faces 601 and 605 or by welding along the respective perimeters 611 and 613 of portions 603 and 607.

Figure 6C:
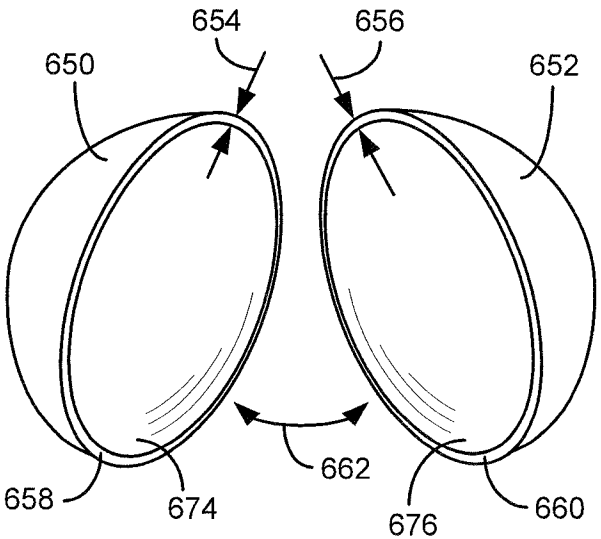
FIG. 6C is schematic diagram of an exploded isometric view of an embodiment of a two-piece test golf ball formed from hollow hemispherical portions.
Figure 6B:
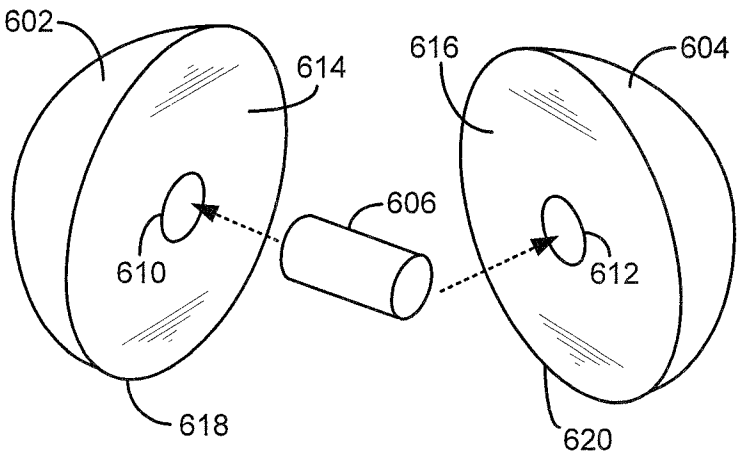
FIG. 6B is a schematic diagram of an exploded isometric view of an embodiment of a two-piece test golf ball formed from substantially solid hemispherical portions joined by a dowel.

In another implementation, two solid hemispherical portions may be joined by a dowel joint, in which a dowel is glued inside aligned opposing holes in the two portions. FIG. 6B illustrates an embodiment of this type of two-piece construction, showing a first hemispherical portion 602, a second hemispherical portion 604, and a dowel 606. The dowel 606 may be secured inside the hole 610 of the first hemispherical portion 602 and inside the hole 612 of the second hemispherical portion 604 by, for example, an interference fit, a glue or adhesive, or combinations thereof. In addition to the dowel 606, the hemispherical portions 602 and 604 may be held together by other means, such as an adhesive applied to their respective interior faces 614 and 616 or by welding along their respective adjoining perimeters 618 and 620.

In another embodiment, the predetermined construction may be a two-piece construction in which two hollow hemispherical portions are joined to form a hollow test golf ball. The hollow hemispherical portions may be joined, for example, by an adhesive, by welding the portions together, by a mechanical connection, or by combinations thereof. FIG. 6C illustrates an embodiment of this type of two-piece construction, showing a first hollow hemispherical portion 650 joining a second hollow hemispherical portion 652, as represented by the arrow 662. Each of the hemispherical portions 650 and 652 may have respective predetermined wall thicknesses 654 and 656. The wall thicknesses 654 and 656 may be the same or different. The hemispherical portions 650 and 652 may have respective edges 658 and 660 that are configured to mate with each other to secure the portions 650 and 652 together. Greater wall thicknesses 654 and 656 may provide larger mating surfaces of the edges 658 and 660. Edges 658 and 660 may also be have complementary shapes to provide a mechanical connection or interference fit, for example, one edge providing a lip, detent, or projection, with the other edge providing a corresponding channel, recess, or other depression. In some embodiments, the edges 658 and 660 may be glued or welded together.

Any suitable material may be used to form a test golf ball. Preferred embodiments may use materials that may be conveniently mixed with other materials to adjust specific gravity and that may be easily manufactured into the predetermined test golf ball construction. For example, ABS or polyoxymethylene plastic may be used. Additives may be mixed with a base material to achieve a desired specific gravity. A designer may use a computer design apparatus, such as apparatus 202 of FIG. 2, to identify suitable materials and to calculate ratios of materials and additives necessary to achieve desired a specific gravity. Apparatus 202 may be specially programmed to identify potential materials and/or material mixtures meeting the desired specific gravity.

Referring again to FIG. 1, after selecting the material, method 100 may continue in step 108 by using the selected material to form a test golf ball having the predetermined construction. In one embodiment, in the case of a one-piece construction, the test golf ball may be formed monolithically using the selected material. The selected material may be monolithically formed into the size, shape, and dimple design of the proposed golf ball to form the test golf ball. The test golf ball may be formed, for example, by machining or by molding, using a test golf ball manufacturing apparatus 204, as depicted in FIG. 2. In other embodiments using two-piece constructions, the selected material may be used to form two hemispherical portions that are then joined together to form the test golf ball, such as is shown in the examples of FIGS. 6A-6C. For those embodiments, the hemispherical portions may be formed, for example, by machining or by molding, using test golf ball manufacturing apparatus 204.

In embodiments using a one-piece test golf ball construction, the test golf ball may be molded as one piece, for example, by injection molding. In other embodiments using a one-piece test golf ball construction, the test golf ball may be machined (e.g., milled) out of a solid block of the selected material using a test golf ball manufacturing apparatus 204. In these machining embodiments, apparatus 204 may be, for example, a milling machine that is manually operated, mechanically automated, or digitally automated via computer numerical control (CNC). The test golf ball may be formed (e.g., by injection molding into a monolithic piece or by machining a solid block) directly into the outer form of the proposed golf ball, including the desired dimple design. Alternatively, a golf ball blank may first be formed (e.g., by injection molding a monolithic piece or by machining a solid block), with the golf ball blank being substantially equal in size and shape to the size and shape of the proposed golf ball and having a smooth outer surface (i.e., no dimple pattern). Subsequently, that golf ball blank may be further processed to form the dimple design into the outer surface of the golf ball blank. For example, the dimple design may be formed by mechanical machining (e.g., milling), compression molding, stamping, electro-discharge machining ("EDM"), chemical etching, hobbing, or combinations thereof.

In embodiments using a multi-piece test golf ball construction, the individual pieces of a test golf ball may be molded or may be machined (e.g., milled) out of a solid block of the selected material using a test golf ball manufacturing apparatus 204. In machining embodiments, apparatus 204 may be, for example, a milling machine that is manually operated, mechanically automated, or digitally automated via computer numerical control (CNC). The pieces of the test golf ball may be formed (e.g., by machining or molding) directly into portions of the outer form of the proposed golf ball, including the desired dimple design. Alternatively, the pieces of the test golf ball may first be formed into portions of a golf ball blank that when assembled are substantially equal in size and shape to the size and shape of the proposed golf ball and having a smooth outer surface (i.e., no dimple pattern). Subsequently, with the different pieces assembled into a golf ball blank, the blank may be further processed to form the dimple design into the outer surface of the golf ball blank. For example, the dimple design may be formed by mechanical machining (e.g., milling), compression molding, stamping, electro-discharge machining ("EDM"), chemical etching, hobbing, or combinations thereof.

Embodiments using a one-piece or multi-piece golf ball blank may include provisions for aligning a dimple design applied to a golf ball blank. In embodiments, a test golf ball may be manufactured from a golf ball blank that includes indexing tabs for further manufacturing, for example, of the dimple pattern. After forming dimples into a golf ball blank according to a desired specification, the indexing tabs may be cut, ground, and/or buffed off.

Figure 5:
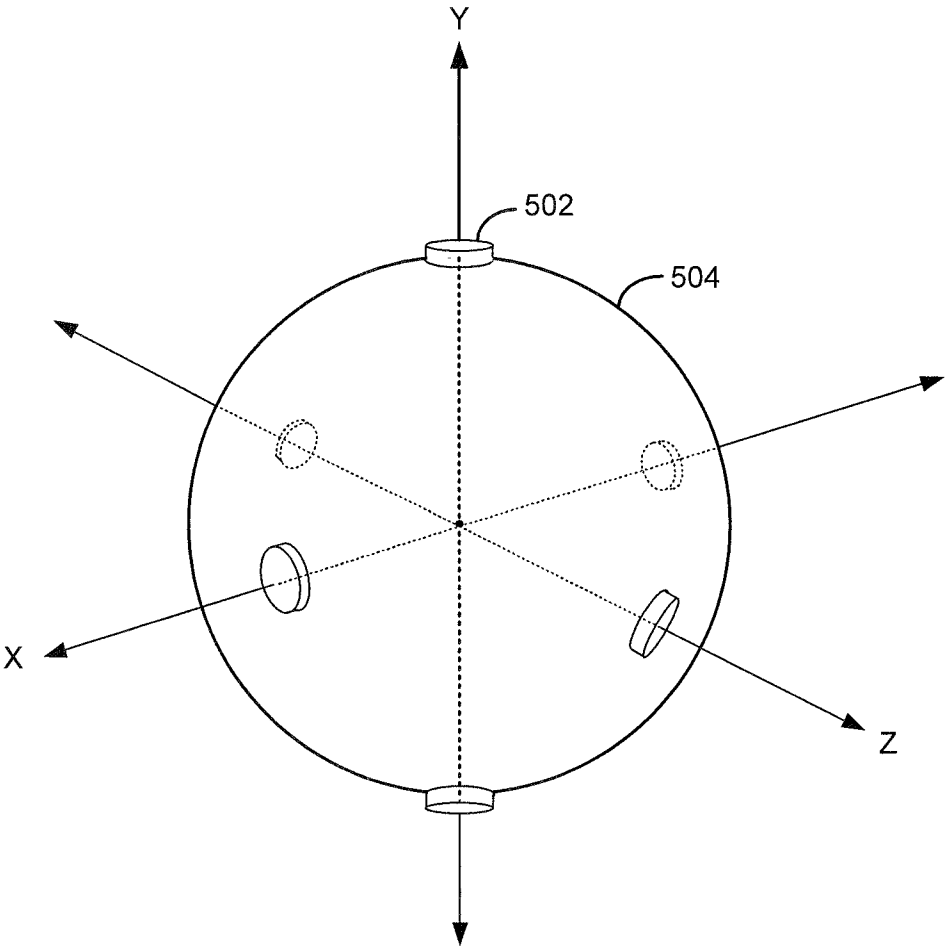
FIG. 5 is a schematic diagram that illustrates an embodiment of a test golf ball blank having index tabs.

In one embodiment, a golf ball blank may have index tabs positioned at the six X-, Y-, and Z-axis points on the surface of the spherical golf ball blank, assuming the center of the ball to coincide with the origin of the Cartesian coordinate system. For example, FIG. 5 illustrates an embodiment of a test golf ball blank 504 having six index tabs 502. In machining the dimple design into the blank, the dimple design may be aligned using the index tabs. The index tabs may be removed after machining the dimple design onto the blank, for example, by cutting, grinding, and/or buffing the index tabs off.

In other embodiments, a test golf ball may be formed by injecting the selected material into a mold to form the entire test golf ball or portions of the test golf ball, such as two hemispherical portions. In these embodiments, test golf ball manufacturing apparatus 204 of FIG. 2 may be an injection molding machine or injection press. In one embodiment, a mold may be formed corresponding to the size, shape, and dimple design of the proposed golf ball. The selected material may then be injected in liquid form into the mold. The material may then be cooled and solidified into the size, shape, and dimple design of the proposed golf ball to form the test golf ball. The test golf ball may then be removed from the mold.

In another embodiment, multiple molds may be formed corresponding to the size, shape, and dimple design of portions of the proposed golf ball, such as hemispherical portions of the proposed golf ball. The selected material may then be injected in liquid form into the multiple molds. The material may then be cooled and solidified into the size, shape, and dimple design of the portions of the proposed golf ball. The portions may then be assembled into the test golf ball. Alternatively, instead of multiple molds, a single mold may be used where the portions are identical.

Referring again to FIG. 1, after forming the test golf ball, method 100 may continue in step 110 by testing the test golf ball using a test golf ball testing apparatus 206. Testing may involve aerodynamic testing, for example. The aerodynamic testing may evaluate aerodynamic properties such as the coefficient of lift or drag of the test golf ball. Testing may involve placing the test golf ball in moving fluid, such as in a wind tunnel, to observe how the moving fluid and the test golf ball interact. Testing may also involve impacting the test golf ball multiple times, such as fifteen or more times. The impacts may be from a club striking the test golf ball or from a structure against which the test golf ball is propelled. To accommodate tests involving impacts, a material selected for a test golf ball is preferably durable enough to withstand fifteen or more impacts. To conduct the tests, test golf ball testing apparatus 206 may comprise one or more of a wind tunnel, an underwater aquadynamic testing apparatus, and a mechanical golfer and indoor test range, such as that provided at the Indoor Test Range at the United States Golf Association Research and Test Center. An impact may be an impact against a test golf ball by a golf club swung by a person or machine, or may be a simulated impact of a golf club using a substitute object, such as a metal plate.

Following testing, a designer may conclude that the proposed golf ball is deficient in one or more performance characteristics. In that case, method 100 may be repeated for a new proposed golf ball. Method 100 may be repeated as many times as necessary to determine an acceptable proposed golf ball design.

Method 100 of FIG. 1 may be practiced in a serial manner, forming and testing a test golf ball through steps 102 to 110 to evaluate a first proposed golf ball, and then repeating those steps for a second proposed golf ball. This approach may be helpful when the results of the evaluation of a first proposed golf ball are instructive in designing a second proposed golf ball. In other embodiments, method 100 may be practiced in a parallel manner, in which multiple proposed golf ball designs are simultaneously formed as test golf balls and tested. In other embodiments, method 100 may be practiced in combinations of the serial and parallel approaches.

Further embodiments may include provisions for rapidly prototyping and testing individual dimple designs on a predetermined golf ball inner construction. In this situation, a designer may have settled upon an inner multi-layered construction and may desire to experiment with different dimple designs for that particular inner multi-layered construction. Accordingly, embodiments enable a quick formation of a proposed dimple design onto a test golf ball blank for testing purposes.

Figure 3:
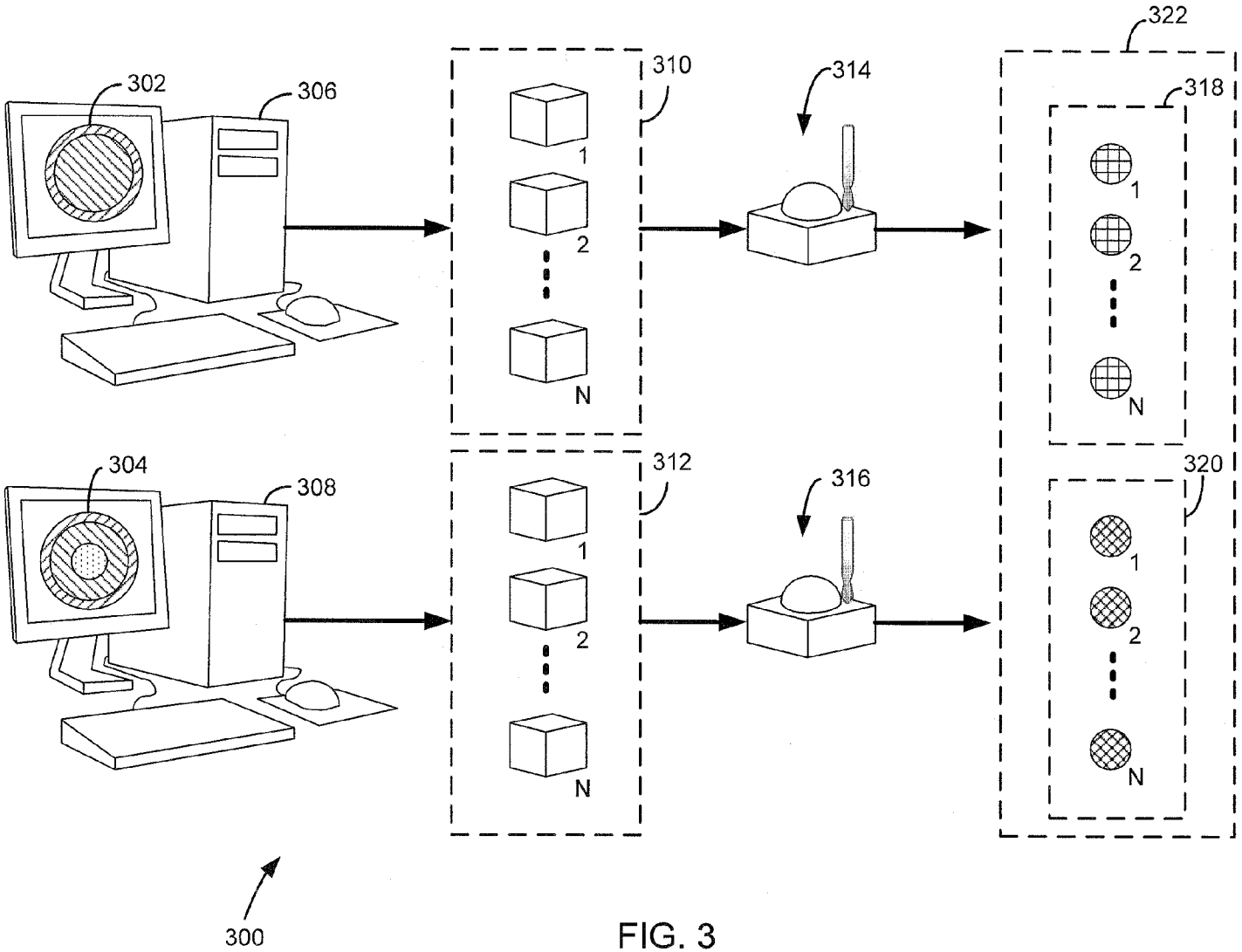
FIGS. 3 and 4 are schematic diagrams that illustrate an embodiment of a method for evaluating a plurality of proposed golf ball designs.

FIG. 3 is a schematic diagram illustrating an embodiment of a rapid dimple design prototyping process 300. As shown, process 300 begins by designing one or more proposed golf ball inner constructions. In this embodiment, for example, a first proposed golf ball inner construction 302 may be designed having a two-piece construction as shown, and a second proposed golf ball inner construction 304 may be designed having a three-piece construction as shown. The proposed golf ball inner constructions may be designed on computers 306 and 308 using CAD software. At this point, the proposed golf ball inner constructions may not include any dimple design, i.e., the outer surfaces of the designs may be smooth. In addition to designing inner constructions having different numbers of layers, the proposed golf ball inner constructions may include constructions having the same number of layers, but varying in those layers, for example, in thickness or material.

After completing one or more proposed golf ball inner construction designs, process 300 may continue by fabricating a plurality of test golf ball blanks for each design. Fabricating the blanks may involve determining a specific gravity of a proposed golf ball inner construction, selecting a material that will mimic the specific gravity of the proposed golf ball when formed into a test golf ball blank having a predetermined construction, and forming the blank from the selected material, as discussed above in reference to steps 104-108 of FIG. 1.

In one embodiment using a one-piece test golf ball construction, as shown in FIG. 3, the test golf ball blanks may be fabricated by first forming, for each of the proposed golf ball inner construction designs, blocks made of the selected material for the particular design. For example, for the two-piece proposed golf ball construction design 302, a plurality of 1 . . . N blocks 310 may be formed from a material that will mimic the specific gravity of the design 302 when formed into the predetermined one-piece test golf ball construction. Likewise, for the three-piece construction design 304, a plurality of 1 . . . N blocks 312 may be formed from a material that will mimic the specific gravity of the design 304 when formed into the predetermined one-piece test golf ball construction.

With a plurality of blocks formed for each design, method 300 may continue by machining each block into the size and outer spherical shape of the each design, without dimples. FIG. 3 illustrates this machining stage 314 and 316 for each design 302 and 304, respectively. Machining may be accomplished using a milling machine or a laser machining tool, for example. Machining may also involve forming index tabs for use as a guide in subsequent forming of dimples, as described above.

Following machining, a plurality of undimpled test golf ball blanks may be obtained for each of the proposed golf ball inner constructions. For example, as shown in FIG. 3, a plurality of golf ball blanks 318 may be obtained for proposed golf ball inner construction 302, and a plurality of golf ball blanks 320 may be obtained for golf ball inner construction 304. Thus, an inventory 322 of golf ball blanks may be obtained for each of the proposed inner construction designs. Each of the blanks may be marked to indicate to which proposed design it corresponds, and may also include index tabs for alignment purposes in a subsequent forming of a dimple design into the surface of the blank.

As an alternative, the process 300 of FIG. 3 may be used to machine portions of test golf ball blanks at stages 314 and 316, instead of a one-piece test golf ball blank. In this alternative two-piece construction embodiment, the test golf ball blank portions (e.g., hemispherical portions) formed at stages 314 and 316 may then be joined together to form the individual two-piece test golf ball blanks 318 and 320. The portions may be joined by the methods described above, such as those discussed in reference to FIGS. 6A-6C.

In another embodiment, instead of machining the test golf ball blanks from blocks of selected material (as shown in FIG. 3), the test golf ball blanks may be produced by injection molding the blanks. In this embodiment, the selected material may be injected into a mold having the same size and outer spherical shape of a proposed golf ball inner construction design. The mold may form a smooth outer surface, and may include index tabs for alignment purposes in subsequent forming of a dimple design. In embodiments, the same mold may be used for all proposed golf ball inner construction designs having the same size and outer spherical shape, thereby simplifying the fabrication of the test golf ball blanks and saving time and money. With a single mold for all of the proposed golf ball inner constructions (each having the same size and outer spherical shape), a designer may simply select the appropriate material for a proposed design and then injection mold a plurality of test golf ball blanks.

In other embodiments, instead of injection molding an entire test golf ball blank, the process 300 may injection mold portions of a test golf ball blank, such as two hemispherical portions. In this alternative two-piece construction embodiment, the test golf ball blank portions formed at stages 314 and 316 may then be joined together to form the individual two-piece test golf ball blanks 318 and 320. The portions may be joined by the methods described above, such as those discussed in reference to FIGS. 6A-6C.

Having amassed an inventory of test golf ball blanks, a golf ball designer may then create and quickly prototype various dimple designs. A designer may create a dimple design and then apply it to different proposed golf ball inner constructions, choosing the corresponding test golf ball blank from the inventory for each of the proposed designs. A designer may also create a plurality of dimple designs for a particular proposed golf ball inner construction, retrieve a golf ball blank corresponding to the proposed inner construction design for each of the proposed dimple designs, and fabricate a test golf ball for each of the proposed dimple designs. A designer may manufacture the test golf balls for the proposed inner construction designs in a serial manner, a parallel manner, or a combination of those approaches.

Figure 4:
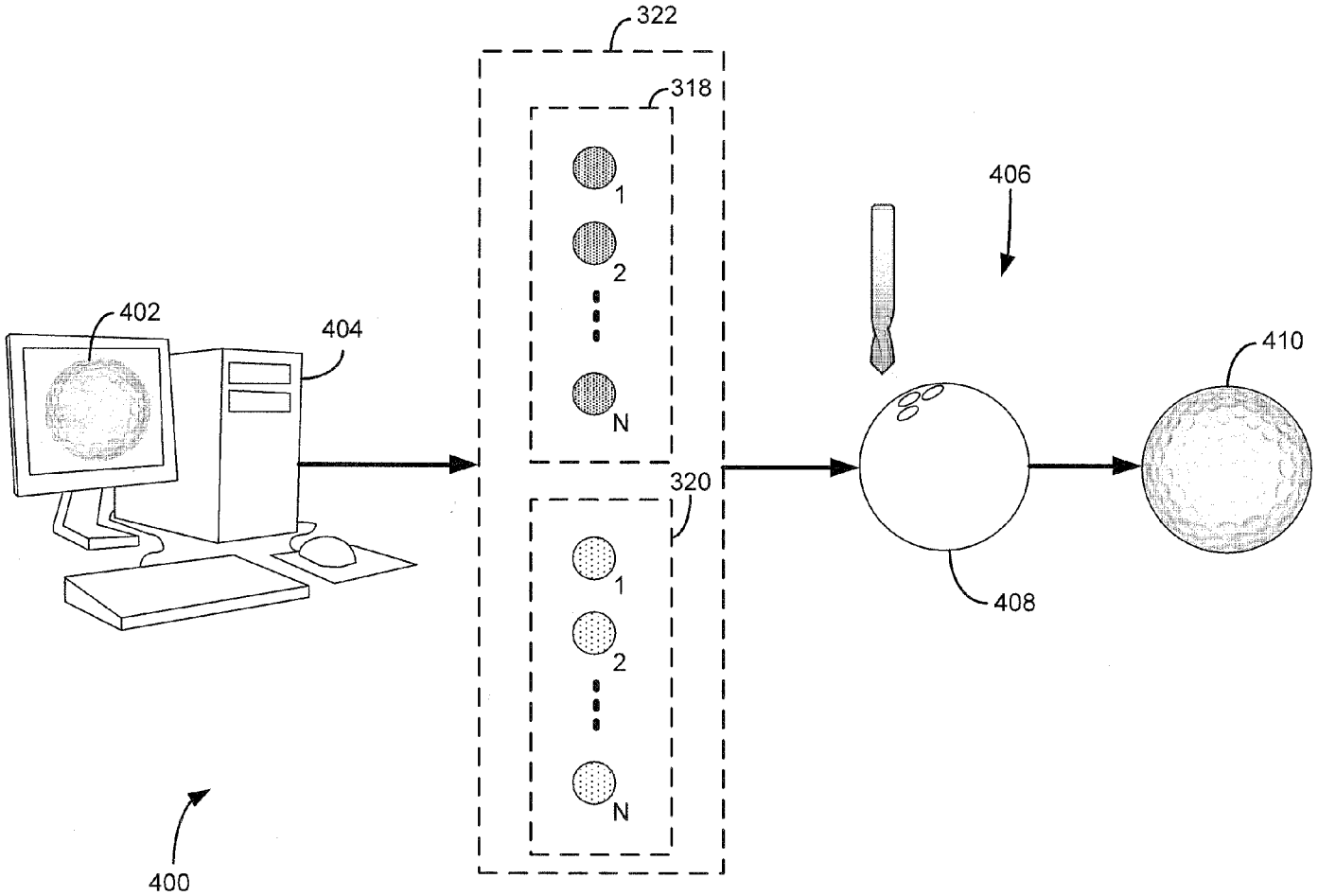

FIG. 4 illustrates an embodiment of a rapid dimple design prototyping process 400. As shown, a proposed dimple design 402 may be first created on a computer 404 using CAD or other software. The proposed dimple design 402 may be applied to a predetermined proposed golf ball inner construction design, for which golf ball blanks have been previously fabricated, for example, as discussed above in reference to FIG. 3.

With the proposed dimple design 402 completed, a user may then retrieve from the inventory 322 a golf ball blank corresponding to the proposed golf ball inner construction to which the dimple design 402 was applied. For instance, in the example illustrated in FIGS. 3 and 4, if the proposed dimple design 402 has been applied to two-piece construction 302, a golf ball blank from the plurality of golf ball blanks 318 may be retrieved from inventory 322. Likewise, if the proposed dimple design 402 has been applied to three-piece construction 304, a golf ball blank from the plurality of golf ball blanks 320 may be retrieved from inventory 322.

With the appropriate golf ball blank 408 retrieved, the rapid dimple design prototyping process 400 may continue in a dimple fabrication stage 406, forming the dimple design into the outer surface of the retrieved golf ball blank 408, as represented in FIG. 4. The proposed dimple design 402 may be formed by machining the surface of the golf ball blank 408, using a milling machine, for example. In one embodiment, index tabs provided on the golf ball blank may assist in aligning the dimple design 402 on the outer surface of the golf ball blank 408.

With the fabrication stage 406 completed, a test golf ball 410 may be provided, which has a specific gravity substantially the same as the specific gravity of the proposed golf ball inner construction, such that the mass of the test golf ball 410 is substantially the same as the computed mass of the proposed golf ball having the proposed inner construction and dimple design. Test golf ball 410 may then be performance-tested to evaluate the proposed golf ball.

As represented in FIG. 4, establishing an inventory 322 of test golf blanks may provide surprising, beneficial results when implemented in a golf ball prototyping process. With the inventory 322 established, and golf ball blanks already available, a golf ball designer may quickly progress from creation of a dimple design to testing of an actual golf ball prototype. Given a predetermined inner construction, a designer may create a dimple design, quickly apply that design to an appropriate golf ball blank, and subject the test golf ball to actual performance tests in a matter of minutes or hours. The time from dimple design to actual prototype may be further minimized by employing rapid fabrication methods in the fabrication stage 406. For example, fabrication stage 406 may involve the use of multiple machining tools, high-speed machining tools, laser machining tools, ball-end milling machines, compression molding, stamping, multi-axis machining, electro-discharge machining ("EDM"), chemical etching, hobbing, or combinations thereof.

To further quicken the dimple design prototyping process 400, embodiments of process 400 may also be partially or fully automated. For example, a golf ball designer may electronically send a completed proposed inner construction and dimple design to a computerized test golf ball fabrication apparatus that, without human intervention, automatically retrieves from an inventory a golf ball blank corresponding to the predetermined inner construction, transports the retrieved golf ball blank to a dimple forming apparatus, and controls the dimple forming apparatus to form the predetermined dimple design into the surface of the blank. The computerized test golf ball fabrication apparatus may then output a completed test golf ball.

These rapid prototyping approaches may also be employed in the process 100 described above.

In establishing an inventory of golf ball blanks as exemplified in FIGS. 3 and 4, embodiments may include provisions for estimating the specific gravity of a proposed golf ball design, to allow for the golf ball blanks to be formed before creating a dimple design. In other words, embodiments account for the fact that fabricating test golf ball blanks without a final dimple design in mind may affect the specific gravity of a proposed golf ball design, and therefore the selection of a test golf ball material that approximates the specific gravity of the proposed golf ball design.

Thus, in one embodiment, an average total dimple volume may be factored in when determining the specific gravity of a proposed golf ball design. For example, after creating a proposed golf ball inner construction having a smooth outer surface (i.e., no dimples), an average total dimple volume may be deducted from the outer layer or outer layers of the proposed inner construction design to compute a dimple-adjusted specific gravity. That dimple-adjusted specific gravity may then be used to select a material for fabrication of the test golf ball blank. The average total dimple volume may be an average of the volumes of dimple designs typically considered in designing golf balls, and may be expressed in terms of a percent dimple volume. A percent dimple volume may be, for example, 0.75 to 1.3%, and defined as the sum of volumes of dimple spaces each defined below a plane circumscribed by the upper edges of the dimples divided by the entire volume of the outer smooth surface of proposed inner construction design without dimples (e.g., a phantom sphere given on the assumption that no dimples are on the golf ball surface).

In considering average total dimple volume in this embodiment, a method for evaluating golf ball designs may comprise designing a plurality of proposed golf balls, each proposed golf ball having an inner construction, an outer spherical shape, and an outer spherical surface. For each proposed golf ball, a proposed design mass of the proposed golf ball may be determined, assuming the outer spherical surface to be smooth. For each proposed golf ball, an average total dimple volume may be designated, and then a material may be selected that, when formed into the predetermined test golf ball construction having the outer spherical shape of the proposed golf ball with a smooth outer spherical surface, weighs the sum of the proposed design mass and the mass of a volume of the material equal to the average total dimple volume. For each proposed golf ball, a plurality of golf ball blanks may be formed from the selected material, to provide an inventory of blanks for each proposed golf ball. A dimple design may then be designed and a proposed golf ball to which the dimple design is to be applied may be selected. A blank corresponding to the selected proposed golf ball may then be retrieved from the inventory. The dimple design may then be formed into the retrieved blank to form a test golf ball, which may then be tested.

In another embodiment, to provide more accuracy over the average total dimple volume method described above, test golf ball blanks may be prefabricated for different dimple volumes, with each blank formed from a material appropriate for its designated dimple volume. The test golf ball blanks may be marked to indicate the dimple volume for which they have been designed, and may be segregated and stored according to dimple volume. In testing and evaluating a particular dimple design having a particular dimple volume, a golf ball designer may then retrieve a blank that has been prefabricated for that particular dimple volume.

In another embodiment, the dimple volume may be ignored in computing the specific gravity of a proposed golf ball inner construction. In other words, the specific gravity of a proposed golf ball inner construction may be computed under the assumption that the outer surface is smooth, with no dimples. A test golf ball blank material may then be chosen based on the specific gravity of the undimpled proposed golf ball inner construction design. In this situation, the final mass of a test golf ball may be slightly different from the computed mass of the proposed golf ball with dimples, due to the difference between the specific gravity of the blank material and the specific gravity of the outer layer or outer layers of the proposed golf ball design in which the dimples are formed. However, this slight difference may be acceptable for prototyping purposes, especially in early evaluations of a proposed dimple design.

In this embodiment, a method for evaluating golf ball designs may comprise designing a plurality of proposed golf balls, each proposed golf ball having an inner construction, an outer spherical shape, and an outer spherical surface. For each proposed golf ball, an undimpled mass of the proposed golf ball may be determined, assuming the outer spherical surface to be smooth. For each proposed golf ball, a material may be selected that, when formed into the predetermined test golf ball construction having the outer spherical shape of the proposed golf ball with a smooth outer spherical surface, weighs the undimpled mass. For each proposed golf ball, a plurality of golf ball blanks may be formed from the selected material, to provide an inventory of blanks for each proposed golf ball. A dimple design may then be designed, and a proposed golf ball to which the dimple design is to be applied may be selected. A blank corresponding to the selected proposed golf ball may be retrieved from the inventory and the dimple design may be formed into the retrieved blank to form a test golf ball. The test golf ball may then be tested to evaluate the golf ball design.

In some embodiments, a structural design of a test golf ball may allow adjustments in mass to provide a test golf ball having a specific gravity as close as possible to the specific gravity of the actual golf ball. In one embodiment, with a multi-piece test golf ball, material may be added or removed from interior portions of the separate pieces. For example, in a test golf ball having two hemispherical portions, material may be added or removed from an interior face of the hemispherical portions, such as the interior faces 601 and 605 of FIG. 6A, the interior faces 614 and 616 of FIG. 6B, and the interior faces 674 and 676 of FIG. 6C. Material may be removed by, for example, cutting, drilling, shaving, sanding, or otherwise machining an interior surface. Material may be added, for example, by injecting, spraying, or otherwise applying a coating or adhesive, or by attaching preformed weights with adhesive.

In some embodiments, a structure of test golf ball may be adjusted to mimic flight or spin characteristics of a proposed golf ball. For example, to mimic a moment of inertia of a proposed golf ball, a test golf ball may be designed with two hollow hemispherical portions, which, in comparison to a monolithic test golf ball, may better approximate the outwardly distributed mass typical of multi-layered proposed golf ball designs.

EXAMPLES

Examples of the invention are given below for purposes of illustration and are not intended to limit the invention in any way. The examples describe embodiments of test golf balls that were actually manufactured and performance-tested, to evaluate aspects of manufacturability and durability, and to compare their performance characteristics to the actual golf balls after which the test golf balls were modeled. In the context of the invention, the actual golf balls represented the proposed golf ball designs. The examples demonstrated that the test golf balls may adequately mimic the performance of actual (or proposed) golf balls in the performance characteristics of drag and lift.

Example 1

In this example, two substantially solid multi-piece test golf balls were manufactured based on the design of an actual golf ball and subjected to aerodynamic testing at an indoor test range. Each multi-piece test golf ball was made of nylon and was constructed from two solid hemispherical portions attached together by a glued dowel, in a manner similar to that described above in reference to FIG. 6B. Each test golf ball was formed to have substantially the same diameter as the actual golf ball. In addition, the outer spherical surface of each test golf ball was machined to form substantially the same dimple pattern as the actual golf ball. There were minor variations in overall dimensions, dimple dimensions, and surface roughness due to differences in manufacturing methods and materials between the test golf balls and the actual golf ball.

The type of nylon material was chosen to achieve a mass of the assembled test golf ball approximating the mass of the actual golf ball, taking into account such factors as the use of the dowel, the glue, and the holes in the hemispherical portions. A nylon material was chosen that provided a mass slightly higher than the mass of the actual golf ball so that the mass of the test golf ball could be fine-tuned by removing small amounts of material from the interior faces of the hemispherical portions, such as the interior faces 614 and 616 shown in the example of FIG. 6B. The assembled test golf balls therefore had small internal voids where material was removed. This fine-tuning enabled the test golf balls to have a mass substantially the same as the actual golf balls.

The test golf balls were shot through an indoor test range at 110 mph with 1740 rpm, traveling approximately 70 feet before impact. The test golf balls were shot in a pole-over-pole orientation ("pole orientation") and a poles-horizontal orientation ("seam orientation"). The lift and drag of the test golf balls were measured and computed. The actual golf balls were subjected to the same tests, measurements, and computations. The lift and drag characteristics were then compared between the test golf balls and the actual golf balls.

Both the coefficient of drag ($C_D$) and also the coefficient of lift ($C_L$) may be used to quantify the force imparted to a ball in flight, and may be dependent on factors such as air density, air viscosity, ball speed, and spin rate. The influence of all of those factors may be embodied in two dimensionless parameters: Spin Ratio (SR) and Reynolds Number (Re). Spin Ratio is the rotational surface speed of the ball divided by ball speed. Reynolds Number quantifies the ratio of inertial to viscous forces acting on the golf ball moving through air.

In this example, the coefficients of drag and coefficients of lift were determined for a given Spin Ratio of approximately 0.08 and a given Reynolds Number of approximately 1.30, using indoor test range methods known in the art. One skilled in the art of golf ball aerodynamics testing would readily understand the determination of lift and drag coefficients using an indoor test range, or alternatively a wind tunnel.

Two sets of tests were conducted, one for pole orientation and one for seam orientation. In each set of tests, six test golf balls and six actual golf balls were shot and evaluated. Table 1 below lists the $C_D$ and $C_L$ results of the six test golf balls shot through the indoor test range in a pole orientation, with the average of the six shots listed at the bottom of the table:

TABLE 1

Test Golf Balls - Pole Orientation

| | Diameter | Re | SR | $C_D$ | $C_L$ |
|---|---|---|---|---|---|
| Shot 1 | 1.6888 | 1.307058 | 0.083128 | 0.215296 | 0.159721 |
| Shot 2 | 1.6888 | 1.302902 | 0.083397 | 0.22402 | 0.170483 |
| Shot 3 | 1.6888 | 1.307745 | 0.083084 | 0.212576 | 0.151422 |
| Shot 4 | 1.6888 | 1.302117 | 0.083447 | 0.223591 | 0.16899 |
| Shot 5 | 1.6888 | 1.304653 | 0.083281 | 0.212791 | 0.153124 |
| Shot 6 | 1.6888 | 1.303279 | 0.083383 | 0.220518 | 0.164482 |
| Average | | 1.3046 | 0.0833 | 0.2181 | 0.1614 |

Table 2 below lists the $C_D$ and $C_L$ results of the six actual golf balls shot through the indoor test range in a pole orientation, with the average of the six shots listed at the bottom of the table:

TABLE 2

| Actual Golf Balls - Pole Orientation | | | | | |
|---|---|---|---|---|---|
| | Diameter | Re | SR | $C_D$ | $C_L$ |
| Shot 1 | 1.6786 | 1.299282 | 0.081293 | 0.231855 | 0.159075 |
| Shot 2 | 1.6786 | 1.30005 | 0.081245 | 0.230515 | 0.156577 |
| Shot 3 | 1.6786 | 1.298834 | 0.081322 | 0.232683 | 0.15832 |
| Shot 4 | 1.6786 | 1.300146 | 0.081238 | 0.229295 | 0.156719 |
| Shot 5 | 1.6786 | 1.300922 | 0.081191 | 0.231063 | 0.156604 |
| Shot 6 | 1.6786 | 1.30151 | 0.081153 | 0.228815 | 0.157684 |
| Average | | 1.3001 | 0.0812 | 0.2307 | 0.1575 |

Table 3 below lists the $C_D$ and $C_L$ results of the six test golf balls shot through the indoor test range in a seam orientation, with the average of the six shots listed at the bottom of the table:

TABLE 3

| Test Golf Balls - Seam Orientation | | | | | |
|---|---|---|---|---|---|
| | Diameter | Re | SR | $C_D$ | $C_L$ |
| Shot 1 | 1.6888 | 1.296837 | 0.083808 | 0.247276 | 0.167667 |
| Shot 2 | 1.6888 | 1.306376 | 0.083182 | 0.212058 | 0.152885 |
| Shot 3 | 1.6888 | 1.307529 | 0.083119 | 0.210263 | 0.149876 |
| Shot 4 | 1.6888 | 1.291747 | 0.08416 | 0.272794 | 0.179988 |
| Shot 5 | 1.6888 | 1.291786 | 0.084184 | 0.267494 | 0.172836 |
| Shot 6 | 1.6888 | 1.307616 | 0.083143 | 0.210443 | 0.151397 |
| Average | | 1.3003 | 0.0836 | 0.2367 | 0.1624 |

Table 4 below lists the $C_D$ and $C_L$ results of the six actual golf balls shot through the indoor test range in a seam orientation, with the average of the six tests listed at the bottom of the table:

TABLE 4

| Actual Golf Balls - Seam Orientation | | | | | |
|---|---|---|---|---|---|
| | Diameter | Re | SR | $C_D$ | $C_L$ |
| Shot 1 | 1.6786 | 1.300817 | 0.081197 | 0.229363 | 0.146892 |
| Shot 2 | 1.6786 | 1.301213 | 0.081169 | 0.22556 | 0.149327 |
| Shot 3 | 1.6786 | 1.302602 | 0.081085 | 0.226553 | 0.14189 |
| Shot 4 | 1.6786 | 1.301135 | 0.081176 | 0.22552 | 0.141934 |
| Shot 5 | 1.6786 | 1.302328 | 0.081102 | 0.226759 | 0.142056 |
| Shot 6 | 1.6786 | 1.299849 | 0.081259 | 0.230823 | 0.143263 |
| Average | | 1.3013 | 0.0812 | 0.2274 | 0.1442 |

Figure 7A:
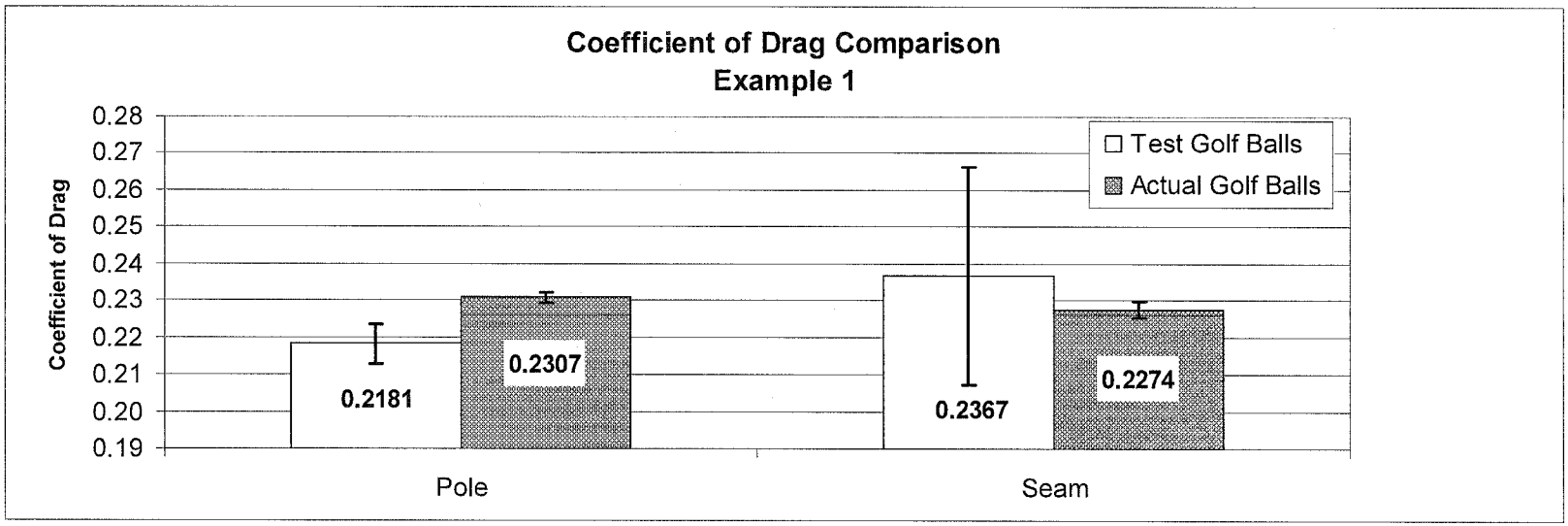
FIG. 7A is a bar graph that depicts the average values of the coefficients of drag $C_D$ for test golf balls and actual golf balls shot in both the pole orientation and the seam orientation, for tests of substantially solid multi-piece test golf balls.

FIG. 7A is a bar graph that depicts the average values of the coefficients of drag $C_D$ for both the pole orientation and the seam orientation.

Figure 7B:
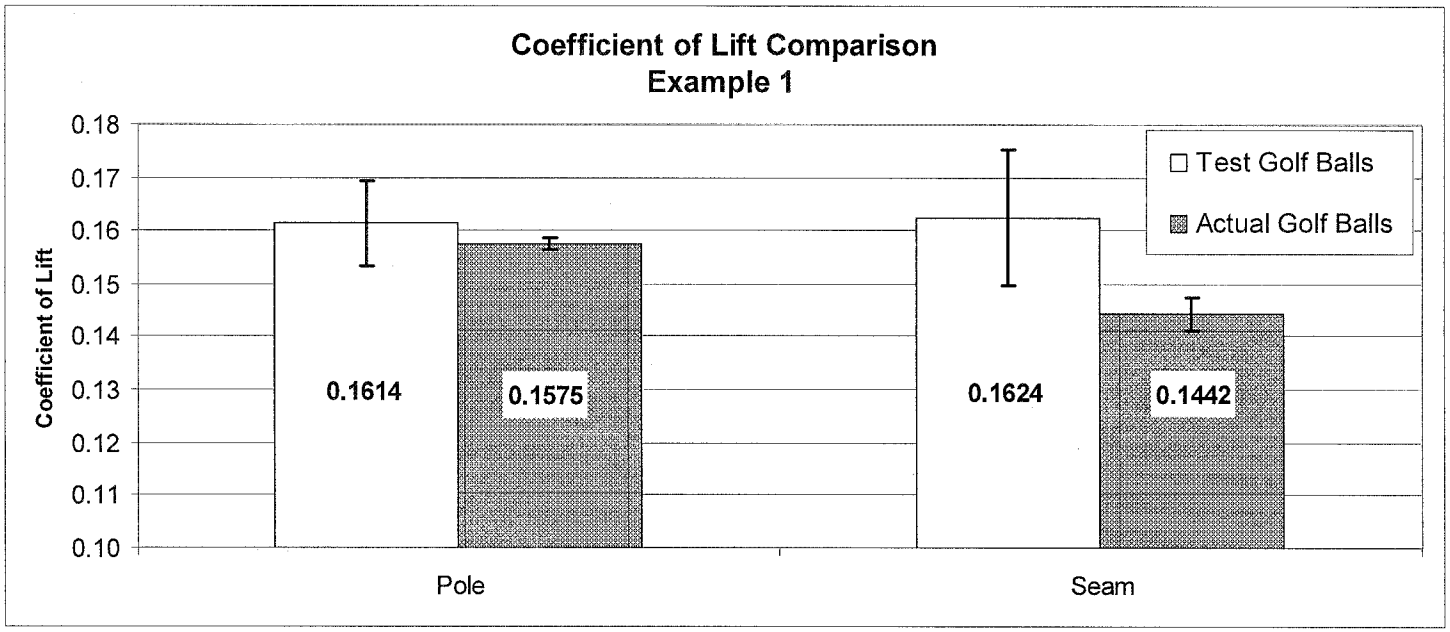
FIG. 7B is a bar graph that depicts the average values of the coefficients of lift $C_L$ for test golf balls and actual golf balls shot in both the pole orientation and the seam orientation, for tests of substantially solid multi-piece test golf balls.

The adjoining bars compare the $C_D$ values for the test golf balls and the actual golf balls. Similarly, FIG. 7B is a bar graph that depicts the average values of the coefficients of lift $C_L$ for both the pole orientation and the seam orientation. The adjoining bars compare the $C_L$ values for the test golf balls and the actual golf balls. The vertical I-shaped error bars drawn over the data bars indicate the standard deviation of the $C_D$ and $C_L$ values across the six shots of each test.

Table 5 below indicates the averages of the tests, the standard deviations, and the variances of the test golf ball data relative to the actual test golf ball data:

TABLE 5

| $C_D$ and CL Variance | | | | |
|---|---|---|---|---|
| | Avg $C_D$ | Std Dev | Avg $C_L$ | Std Dev |
| Test Ball - Pole | 0.2181 | 0.0052 | 0.1614 | 0.0080 |
| Test Ball - Seam | 0.2367 | 0.0295 | 0.1624 | 0.0128 |
| Actual Ball - Pole | 0.2307 | 0.0015 | 0.1575 | 0.0010 |
| Actual Ball - Seam | 0.2274 | 0.0022 | 0.1442 | 0.0031 |
| | $C_D$ Variance | | $C_L$ Variance | |
| Pole: | −5.4% | Pole: | 2.5% | |
| Seam: | 4.1% | Seam: | 12.6% | |

As shown in the tables and graphs, the variance of $C_D$ and $C_L$ data of the test golf balls is somewhat higher than that of the actual test golf balls. Nevertheless, the test golf ball data is reasonable and comparable. In comparison to the actual golf ball, the test golf ball varied in coefficient of drag $C_D$ approximately 5% for the pole orientation and approximately 4% for the seam orientation. The test golf ball varied in coefficient of lift $C_L$ approximately 3% for pole orientation and approximately 13% for seam orientation. Considering the USGA tolerance of 5%, these results demonstrate that the two-piece nylon test golf balls may be suitable for aerodynamic testing, yielding informative data for the design and testing of proposed golf ball designs. In addition, the test golf balls showed good durability during shot testing, exhibiting only minor signs of separation between the two hemispherical portions of the test golf balls.

Example 2

In this example, two hollow multi-piece test golf balls were manufactured based on the design of an actual golf ball and subjected to aerodynamic testing at an indoor test range. Each multi-piece test golf ball was made of polyoxylmethylene (POM) and was constructed from two hollow hemispherical portions, the edges of which were glued together in a manner similar to that described above in reference to FIG. 6C. Each test golf ball was formed to have substantially the same diameter as the actual golf ball. In addition, the outer spherical surface of each test golf ball was machined to form substantially the same dimple pattern as the actual golf ball. There were minor variations in overall dimensions, dimple dimensions, and surface roughness due to differences in manufacturing methods and materials between the test golf balls and the actual golf ball.

The type of POM material was chosen to achieve a mass of the assembled test golf ball approximating the mass of the actual golf ball, taking into account such factors as the use of the glue and the wall thickness of the hollow hemispherical portions. A POM material was chosen that provided a mass slightly higher than the mass of the actual golf ball so that the mass of the test golf ball could be fine-tuned by removing small amounts of material from the interior faces of the hemispherical portions, such as the interior faces 674 and 676 shown in the example of FIG. 6C. The assembled test golf balls therefore had small internal voids where material was removed. This fine-tuning enabled the test golf balls to have a mass substantially the same as the actual golf balls.

The test golf balls were shot through an indoor test range at 110 mph with 1740 rpm, traveling approximately 70 feet before impact. The test golf balls were shot in a pole orientation. The lift and drag of the test golf balls were measured and computed. The actual golf balls were subjected to the same tests, measurements, and computations. The lift and drag characteristics were then compared between the test golf balls and the actual golf balls.

In this example, the coefficients of drag and coefficients of lift were determined for a given Spin Ratio of approximately 0.08 and a given Reynolds Number of approximately 1.30, using indoor test range methods known in the art. One skilled in the art of golf ball aerodynamics testing would readily understand the determination of lift and drag coefficients using an indoor test range, or alternatively a wind tunnel.

One set of tests was conducted, which include three shots of the test golf balls and six shots of the actual golf balls. The shots of the test golf balls were limited due to changes in the structure of the test golf balls caused by the impacts of the testing. Table 6 below lists the $C_D$ and $C_L$ results of the three shots of the test golf balls through the indoor test range in a pole orientation, with the average of the three shots listed at the bottom of the table:

TABLE 6

| Test Golf Balls | | | | | |
|---|---|---|---|---|---|
| | Diameter | Re | SR | $C_D$ | $C_L$ |
| Shot 1 | 1.6842 | 1.295017 | 0.083419 | 0.22885 | 0.175867 |
| Shot 2 | 1.6842 | 1.29665 | 0.083362 | 0.231294 | 0.176363 |
| Shot 3 | 1.6842 | 1.296503 | 0.083369 | 0.226161 | 0.170734 |
| Average | | 1.2961 | 0.0834 | 0.2288 | 0.1743 |

Table 7 below lists the $C_D$ and $C_L$ results of the six shots of the actual golf balls through the indoor test range in a pole orientation, with the average of the six shots listed at the bottom of the table:

TABLE 7

| Actual Golf Balls | | | | | |
|---|---|---|---|---|---|
| | Diameter | Re | SR | $C_D$ | $C_L$ |
| Shot 1 | 1.6823 | 1.307011 | 0.08112 | 0.227541 | 0.17241 |
| Shot 2 | 1.6823 | 1.305984 | 0.081182 | 0.220867 | 0.165929 |
| Shot 3 | 1.6823 | 1.303581 | 0.081333 | 0.222952 | 0.166107 |
| Shot 4 | 1.6823 | 1.305539 | 0.08121 | 0.221745 | 0.160823 |
| Shot 5 | 1.6823 | 1.306692 | 0.08114 | 0.223152 | 0.165752 |
| Shot 6 | 1.6823 | 1.307184 | 0.081107 | 0.222298 | 0.166301 |
| Average | | 1.3060 | 0.0812 | 0.2231 | 0.1662 |

Figure 8A:
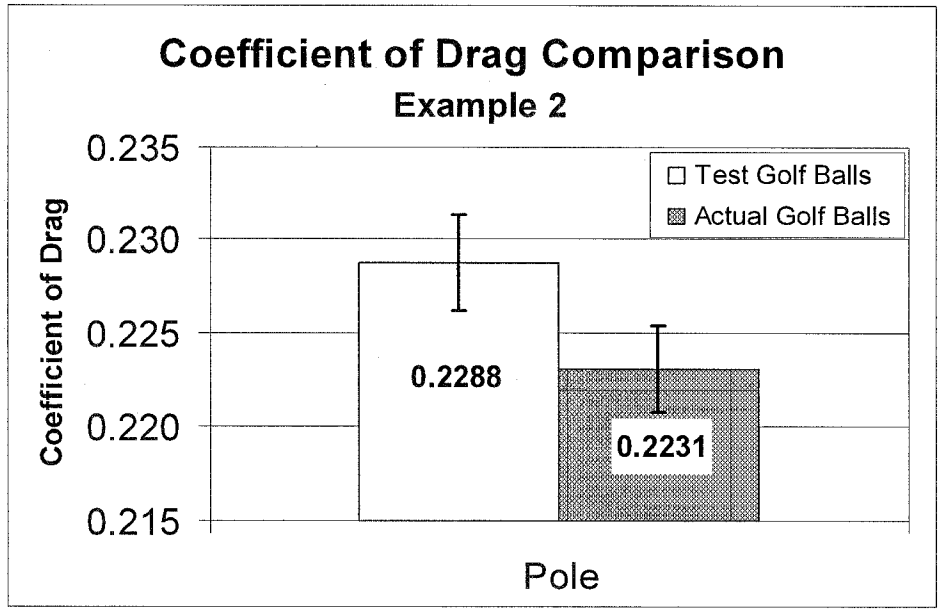
FIG. 8A is a bar graph that depicts the average values of the coefficients of drag $C_D$ for test golf balls and actual golf balls shot in the pole orientation, for tests of hollow two-piece test golf balls.
Figure 8B:
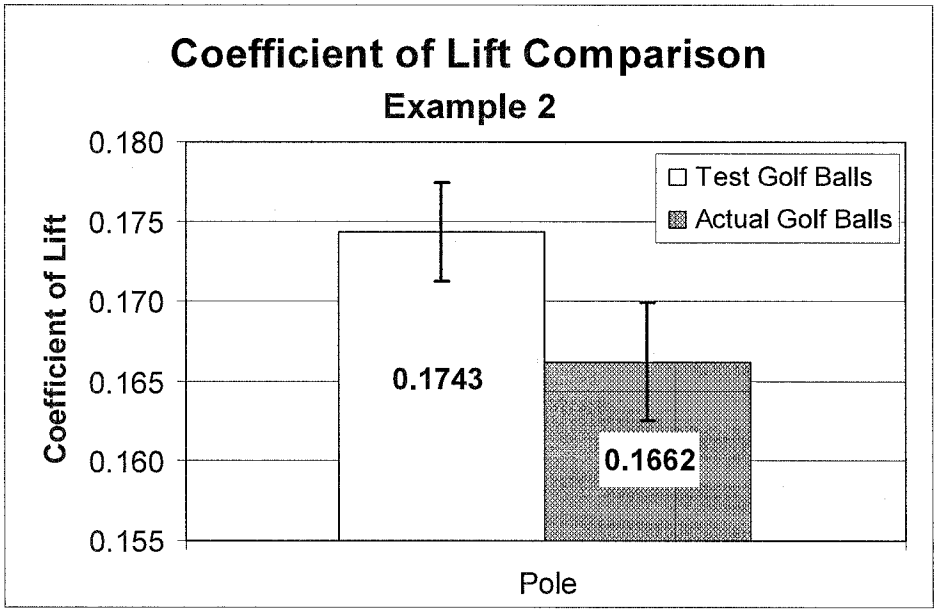
FIG. 8B is a bar graph that depicts the average values of the coefficients of lift $C_L$ for test golf balls and actual golf balls shot in the pole orientation, for tests of hollow two-piece test golf balls.

FIG. 8A is a bar graph that depicts the average values of the coefficients of drag $C_D$ for the test golf balls and the actual golf balls shot in the pole orientation. The adjoining bars compare the $C_D$ values for the test golf balls and the actual golf balls. Similarly, FIG. 8B is a bar graph that depicts the average values of the coefficients of lift $C_L$ for the test golf balls and the actual golf balls shot in the pole orientation. The adjoining bars compare the $C_L$ values for the test golf balls and the actual golf balls. The vertical I-shaped error bars drawn over the data bars indicate the standard deviation of the $C_D$ and $C_L$ values across the shots of each test.

Table 8 below indicates the averages of the tests, the standard deviations, and the variances of the test golf ball data relative to the actual test golf ball data:

TABLE 8

| CD and CL Variance | | | | |
|---|---|---|---|---|
| | Avg CD | Std Dev | Avg CL | Std Dev |
| Test Ball | 0.2288 | 0.0026 | 0.1743 | 0.0031 |
| Actual Ball | 0.2231 | 0.0023 | 0.1662 | 0.0037 |
| CD Variance | −2.5% | | | |
| CL Variance | −4.9% | | | |

As shown in the tables and graphs, the test golf balls exhibited slightly lower lift and drag coefficients in comparison to the actual golf balls. The error was linear. In comparison to the actual golf ball, the test golf ball varied in coefficient of drag $C_D$ approximately 3% and varied in coefficient of lift $C_L$ approximately 5%. Considering the USGA tolerance of 5%, these results demonstrate that the two-piece POM test golf balls may be suitable for aerodynamic testing, yielding informative data for the design and testing of proposed golf ball designs.

The foregoing disclosure of embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims and their equivalents.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to a method and/or process should not be limited to the performance of their steps in the order written, and one skilled in the art can readily appreciate that the sequences may be varied and still remain within the spirit and scope of the present invention.

What is claimed is:

1. A method for evaluating golf ball designs comprising:

designing a plurality of proposed golf balls, each proposed golf ball having a multi-layered construction, an outer spherical shape, and an outer spherical surface;

determining, for each proposed golf ball, a proposed design mass of the proposed golf ball assuming the outer spherical surface to be smooth;

designating, for each proposed golf ball, an average total dimple volume;

selecting, for each proposed golf ball, a material that, when formed into a monolithic test golf ball having the outer spherical shape of the proposed golf ball with a smooth outer spherical surface, weighs the sum of the proposed design mass and the mass of a volume of the material equal to the average total dimple volume;

forming, for each proposed golf ball, a plurality of monolithic golf ball blanks from the selected material, to provide an inventory of monolithic golf ball blanks for each proposed golf ball;

designing a dimple design;

selecting a proposed golf ball to which the dimple design is to be applied;

retrieving from the inventory a monolithic golf ball blank that corresponds to the selected proposed golf ball;

forming the dimple design into the retrieved blank to form a monolithic test golf ball; and testing the monolithic test golf ball.

2. The method of claim 1, wherein the proposed golf ball has a two-piece construction or a three-piece construction.

3. The method of claim 1, wherein selecting the material comprises:

selecting a base material; and doping the base material such that the doped based material, when formed into the monolithic test golf ball having the outer spherical shape of the proposed golf ball with a smooth outer spherical surface, weighs the sum of the proposed design mass and the mass of a volume of the material equal to the average total dimple volume.

4. The method of claim 3, the base material comprising acrylonitrile-butadiene-styrene plastic or polyoxymethylene plastic.

5. The method of claim 1, wherein forming each monolithic golf ball blank from the selected material comprises:

forming the selected material into a block; and machining the block into a golf ball blank substantially equal in size to the size of the each proposed golf ball; and wherein forming the dimple design into the retrieved blank comprises machining the dimple design into the retrieved blank.

6. The method of claim 5, wherein machining the block into the golf ball blank comprises forming index tabs on the golf ball blank, wherein machining the dimple design into the retrieved blank comprises aligning the dimple design using the index tabs, and wherein the method further comprises removing the index tabs after machining the dimple design into the retrieved blank.

7. The method of claim 1, wherein forming each monolithic golf ball blank from the selected material comprises:

forming a mold corresponding to the size of the each proposed golf ball;

injecting the selected material in liquid form into the mold;

cooling the material to solidify the material into the size of the each proposed golf ball to form the each monolithic test golf ball blank; and removing the monolithic test golf ball blank from the mold.

8. The method of claim 1, wherein testing the monolithic test golf ball comprises determining aerodynamic properties of the monolithic test golf ball.

9. The method of claim 8, wherein the aerodynamic properties include a coefficient of lift and a coefficient of drag.

10. The method of claim 1, wherein testing the monolithic test golf ball comprises subjecting the monolithic test golf ball to at least fifteen impacts, and wherein selecting the material comprises selecting a material that withstands the at least fifteen impacts when formed into the monolithic test golf ball.

11. The method of claim 1, wherein the monolithic test golf ball has a mass substantially equal to a computed mass of the proposed golf ball having the dimple design.

12. The method of claim 1, wherein the plurality of proposed golf balls comprises a first proposed golf ball having a two-piece inner construction and a second proposed golf ball having a three-piece inner construction.

13. The method of claim 1, wherein a test golf ball fabrication apparatus automatically executes the retrieval from the inventory of the blank that corresponds to the selected proposed golf ball and the formation of the dimple design into the retrieved blank.

14. The method of claim 1, wherein the average total dimple volume comprises 0.75% to 1.3% of an entire volume of the each proposed golf ball without dimples.

15. The method of claim 1, wherein the average total dimple volume comprises a first average total dimple volume, wherein the material comprises a first material, wherein the plurality of monolithic golf ball blanks comprises a plurality of first monolithic golf ball blanks corresponding to the first average total dimple volume, wherein the dimple design comprises a first dimple design, and wherein the method further comprises:

designating, for each proposed golf ball, a second average total dimple volume;

selecting, for each proposed golf ball, a second material that, when formed into a monolithic test golf ball having the outer spherical shape of the proposed golf ball with a smooth outer spherical surface, weighs the sum of the proposed design mass and the mass of a volume of the material equal to the second average total dimple volume;

forming, for each proposed golf ball, a plurality of second monolithic golf ball blanks from the selected second material, to provide an inventory of second monolithic blanks for each proposed golf ball;

designing a second dimple design having a total dimple volume;

selecting a second proposed golf ball to which the second dimple design is to be applied;

retrieving a first monolithic golf ball blank corresponding to the second proposed golf ball if the total dimple volume of the second dimple design is closer in value to the first average total dimple volume than the second average total dimple volume;

retrieving a second monolithic golf ball blank corresponding to the second proposed golf ball if the total dimple volume of the second dimple design is closer in value to the second average total dimple volume than the first average total dimple volume;

forming the second dimple design into the retrieved first or second monolithic golf ball blank to form a second monolithic test golf ball; and testing the second monolithic test golf ball.

16. A method for evaluating golf ball designs comprising:

designing a plurality of proposed golf balls, each proposed golf ball having a multi-layered construction, an outer spherical shape, and an outer spherical surface;

determining, for each proposed golf ball, an undimpled mass of the proposed golf ball assuming the outer spherical surface to be smooth;

selecting, for each proposed golf ball, a material that, when formed into a monolithic test golf ball having the outer spherical shape of the proposed golf ball with a smooth outer spherical surface, weighs the undimpled mass;

forming, for each proposed golf ball, a plurality of monolithic golf ball blanks from the selected material, to provide an inventory of monolithic golf ball blanks for each proposed golf ball;

designing a dimple design;

selecting a proposed golf ball to which the dimple design is to be applied;

retrieving from the inventory a monolithic golf ball blank that corresponds to the selected proposed golf ball;

forming the dimple design into the retrieved blank to form a monolithic test golf ball; and testing the monolithic test golf ball.

17. The method of claim 16, wherein the plurality of proposed golf balls comprises a first proposed golf ball having a two-piece inner construction and a second proposed golf ball having a three-piece inner construction.

* * * * *